US006897836B2

(12) United States Patent
Tokunaga

(10) Patent No.: US 6,897,836 B2
(45) Date of Patent: May 24, 2005

(54) METHOD FOR DRIVING A DISPLAY PANEL

(75) Inventor: Tsutomu Tokunaga, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 310 days.

(21) Appl. No.: 10/350,020

(22) Filed: Jan. 24, 2003

(65) Prior Publication Data

US 2003/0146910 A1 Aug. 7, 2003

(30) Foreign Application Priority Data

Feb. 1, 2002 (JP) ..... 2002-025012

(51) Int. Cl.[7] ..... G09G 3/28
(52) U.S. Cl. ..... 345/63; 345/60
(58) Field of Search ..... 345/60, 63, 64, 345/65

(56) References Cited

U.S. PATENT DOCUMENTS 5,123,059 A * 6/1992 Hirosawa et al. ..... 382/272
6,014,258 A * 1/2000 Naka et al. ..... 359/618
6,018,329 A * 1/2000 Kida et al. ..... 345/60
6,064,356 A * 5/2000 Shigeta ..... 345/63
2004/0066355 A1 * 4/2004 Shigeta et al. ..... 345/60

FOREIGN PATENT DOCUMENTS

JP 2000-227778 8/2000
JP 2001-312244 11/2001

* cited by examiner

*Primary Examiner*—Amare Mengistu
*Assistant Examiner*—Steven Holton
(74) *Attorney, Agent, or Firm*—Sughrue Mion, PLLC

(57) ABSTRACT

A method of driving a display panel. Weights of all subfields and combinations of light emitting subfields for respective gradation levels are determined to reduce the number of subfields of which light emission states change between two adjacent gradation levels. A plurality of field display sequences are provided such that the combinations of light emitting subfields at at least one gradation level are different from each other between the field display sequences. Fields are sequentially displayed by changing the field display sequences every time a predetermined number of fields of an image signal are displayed.

6 Claims, 10 Drawing Sheets

METHOD FOR DRIVING A DISPLAY PANEL

BACKGROUND OF THE INVENTION

1. Field of the Invention

The present invention relates to a method for driving a display panel which includes a number of discharge cells arranged in a matrix.

2. Description of the Related Art

A plasma display panel (hereinafter referred to as "PDP") is one of two-dimensional image display panels. A plurality of discharge cells are arranged in the form of a matrix in the PDP. Recently, keen attention has been paid to the PDP. The PDP is directly driven by a digital video signal. The number of brightness gradations (grayscale levels, halftone levels) which the PDP can display depends on the number of bits of pixel data for each pixel derived from the digital video signal. A subfield method is known as a method for driving the PDP with a plurality of brightness gradations. In the subfield method, a display period of one field is divided into a plurality of subfields to drive each cell. For example, Japanese Patent Kokai Nos. 2000-227778 and 2001-312244 disclose the PDP driving method using the subfield scheme.

The subfield scheme will be described briefly. First, the display period of one field is divided into a plurality of subfields. Each subfield has an address period and a light emission maintaining period. In the address period, each pixel is set to a light emission possible state (light emission enable state) or a light emission impossible state (light emission disable state) in accordance with the pixel data. In the light emission maintaining period, only pixels in the light emission enable state emit light during a period (defined by the number of light emission) corresponding to the weight of the subfield concerned. That is, whether or not a discharge cell emits light in the subfield is set for each subfield (an address period). Only a discharge cell which is set to the light emission enable state emits light during the period allotted to the subfield (i.e., emits light predetermined times). In one field, therefore, there is a mixture of subfields in the light emitting state and in the light-out (non-light emitting) state. As a result, the human eyes sense intermediate brightness according to a sum of the light emission periods in the respective subfields.

The subfield method poses a problem that a false contour appears on the borders between cells in a certain light emission pattern defined by the discharge cells. This problem will be described in a case where $2^N$ gradations are displayed (created) by N subfields. For the sake of easy understanding, a display of 256 gradations will be described in which each display data is 8-bit long, one field consists of eight subfields SF1 to SF8, and the ratio of the numbers (frequency) of light emission of the subfields is SF1:SF2:SF3:SF4:SF5:SF6:SF7:SF8 = 1:2:4:8:16:32:64:128. In this case, a light emission pattern in which the subfields SF1 to SF7 emit light and the gradation level is 127 (with the subfield SF8 not emitting light) is the inverted pattern of a light emission pattern in which the subfield SF8 emits light (with the subfields SF1 to SF7 not emitting light) and the gradation level is 128. Therefore, a false contour appears. Even when part of a light emission pattern is inverted, a false contour also appears.

To solve such a problem, the Japanese Patent Kokai No. 2000-227778 proposes a gradation display method in which N+1 gradations are displayed by means of N subfields by causing all the subfields to emit light sequentially starting from a first subfield when the number of gradation levels in one field increases. According to this method, there is no inversion of light emitting subfields between two gradation levels when the two gradation levels are different from each other by one level. So in principle, the occurrence of a false contour can be prevented, but a sufficient number of display gradations cannot be obtained.

SUMMARY OF THE INVENTION

An object of the present invention is to provide a method for driving a plasma display panel which can display an image with a sufficient number of gradations and prevent the occurrence of a false contour.

According to one aspect of the present invention, there is provided a method of driving a display panel for each group of subfields defining one field of a video signal, the display panel including a plurality of row electrodes and a plurality of column electrodes intersecting with the row electrode such that a light emissive cell is formed at each intersection of the row and column electrodes, the method comprising: determining a light emission weight of each subfield and a combination of light emitting subfields at each gradation level such that the number of subfields having different light emission states between two adjacent gradation levels is less than a predetermined value; providing a plurality of field display sequences such that the combinations of the light emitting subfields at at least one gradation level are different from each other between the field display sequences; and sequentially displaying fields by changing a currently used field display sequence to another field display sequence each time a predetermined number of fields of the video signal are displayed.

DETAILED DESCRIPTION OF THE INVENTION

Embodiments of the present invention will be described with reference to the accompanying drawings.

First Embodiment

Figure 1:
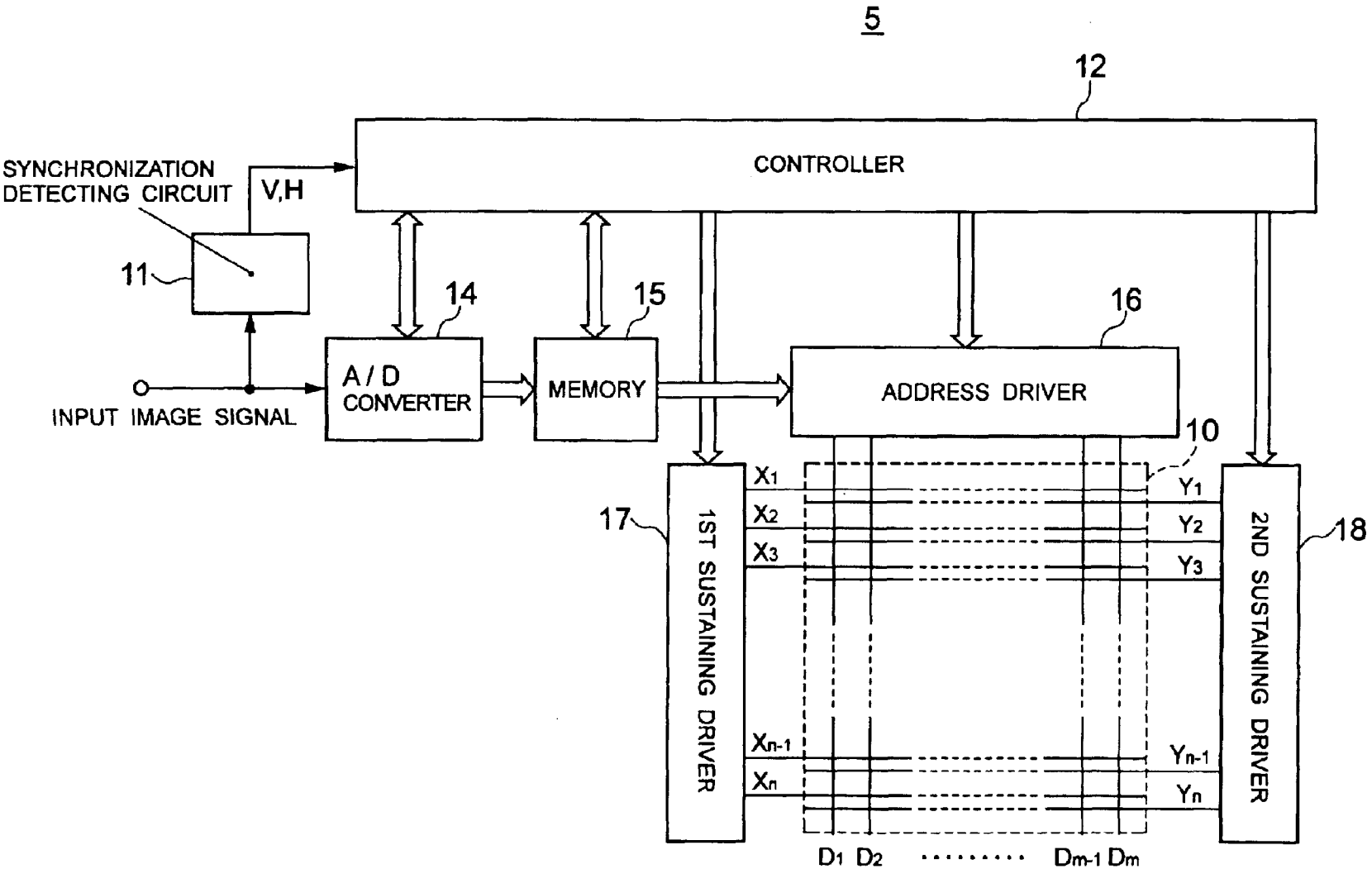
FIG. 1 illustrates a schematic configuration of a plasma display panel device having a plasma display panel according to a first embodiment of the present invention.

Referring to FIG. 1, a schematic configuration of a plasma display device 5, including a plasma display panel according to one embodiment of the present invention, is illustrated.

The plasma display device 5 includes a plasma display panel (hereinafter referred to as PDP) 10 and a drive unit for the PDP 10. The driving unit includes a synchronization detecting circuit 11, a controller 12, an A/D converter 14, a memory 15, an address driver 16, a first sustaining driver 17, and a second sustaining driver 18.

The PDP 10 includes column electrodes $D_1$-$D_m$ as address electrodes, and row electrodes $X_1$-$X_n$ and $Y_1$-$Y_n$ intersecting with the column electrodes at a right angle. In the PDP 10, a pair of the row electrodes X and Y form one display line. The column electrodes $D_1$-$D_m$ are grouped into the column electrodes $D_1, D_4, D_7, \ldots, D_{m-2}$ for emitting red light, the column electrodes $D_2, D_5, D_8, \ldots, D_{m-1}$ for emitting green light, and the column electrodes $D_3, D_6, D_9, \ldots, D_m$ for emitting blue light. Each intersection between each of the column electrodes $D_1$. $D_4, D_7, \ldots, D_{m-2}$ and each of the row electrode pairs X and Y forms a red discharge cell which discharges to emit light in red. Each intersection between each of the column electrodes $D_2, D_5, D_8, \ldots, D_{m-2}$ and each of the row electrode pairs X and Y forms a green discharge cell which discharges to emit light in green. Each intersection between the column electrodes $D_3, D_6, D_9, \ldots, D_m$ and each of the row electrode pairs X and Y forms a blue discharge cell which discharges to emit light in blue. Three adjacent discharge cells in a display line direction, that is, a red discharge cell, a green discharge cell and a blue discharge cell, form one pixel.

The synchronization detecting circuit 11 generates a vertical synchronization signal V when the synchronization detecting circuit 11 detects a vertical synchronization signal in an analog video signal. The synchronization detecting circuit 11 generates a horizontal synchronization signal H when the synchronization detecting circuit 11 detects a horizontal synchronization signal in the analog video signal. The synchronization detecting circuit 11 sends the vertical and horizontal synchronization signals V and H to the controller 12. The A/D converter 14 samples the video signal on the basis of a clock signal supplied from the controller 12, and converts the sampled signal into pixel data PD for each pixel. The A/D converter 14 then sends the pixel data PD to the controller 12 and the memory 15.

The controller 12 generates pixel driving data (display pixel data) GD for displaying multiple gradations based on the pixel data PD. The controller 12 generates the pixel driving data GD by the subfield method in accordance with field display sequences (will be described).

Figure 2:
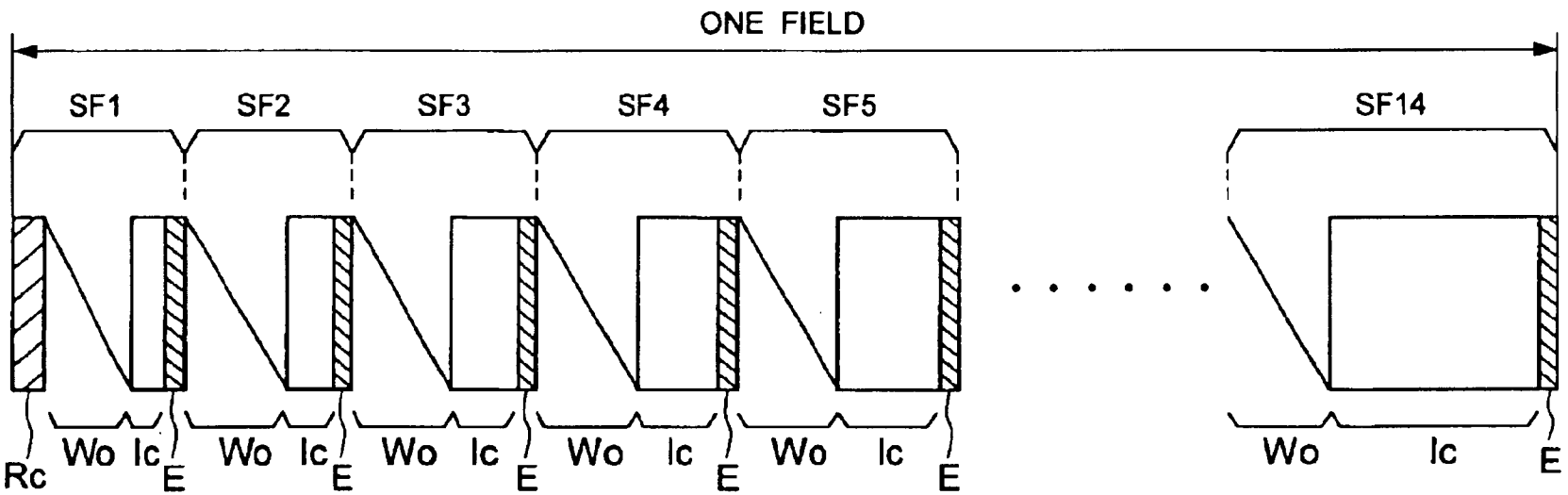
FIG. 2 illustrates a light emission format in the first embodiment.

As shown in the drive format of FIG. 2, the controller 12 divides the display period of one field of a video signal into 14 subfields (subfields SF1 to SF14) when driving each cell to create a plurality of gradations. The first subfield SF1 includes a reset process (Rc), a selective write address process (Wo), a light emission maintaining process (Ic), and an overall light-extinguishing process (E). Each of the subfields SF2 to SF14 following the subfield SF1 includes the selective write address process Wo, the light emission maintaining process Ic, and the overall light-extinguishing process E. The reset process Rc is included in only the head subfield (i.e., the first subfield SF1) for reducing dark brightness. High contrast is achieved by reducing the dark brightness.

In the reset process Rc, all the discharge cells are initialized to the light emission impossible state (light emission disable state). The selective write address process Wo is an address process for selectively setting the discharge cells of the PDP 10 to the light emission possible state (light emission enable state) based on the input video signal. In the light emission maintaining process, the discharge cell(s) set to the light emission enable state in the selective write address process Wo emits light for a period (frequency) corresponding to the number of sustaining pulses applied. The light emission period (frequency) corresponds to the weight of each subfield. In the overall light-extinguishing process E of each subfield, all the discharge cells are set to the light emission disable state.

The controller 12, as described above, displays multiple gradations by making the subfields emit light sequentially starting from the first subfield SF1. Since the display period of one field is divided into the 14 subfields SF1 to SF14 (N=14), 16,384(=$2^N$) gradations can be created. In this embodiment, the combinations of the light emitting subfields in three field sequences are different from each other at at least one gradation level. In addition, a plurality of field display sequences (hereinafter referred to as field sequences) are provided (defined) such that the weights of the subfields and the combinations of the light emitting subfields for the respective gradation levels are specified to reduce the subfields of which light emission states are inverted between two adjacent gradation levels. As mentioned earlier, one gradation level difference exists between the two adjacent gradation levels.

An example of such field sequences will be described with reference to FIGS. 3 to 5.

Figure 3:
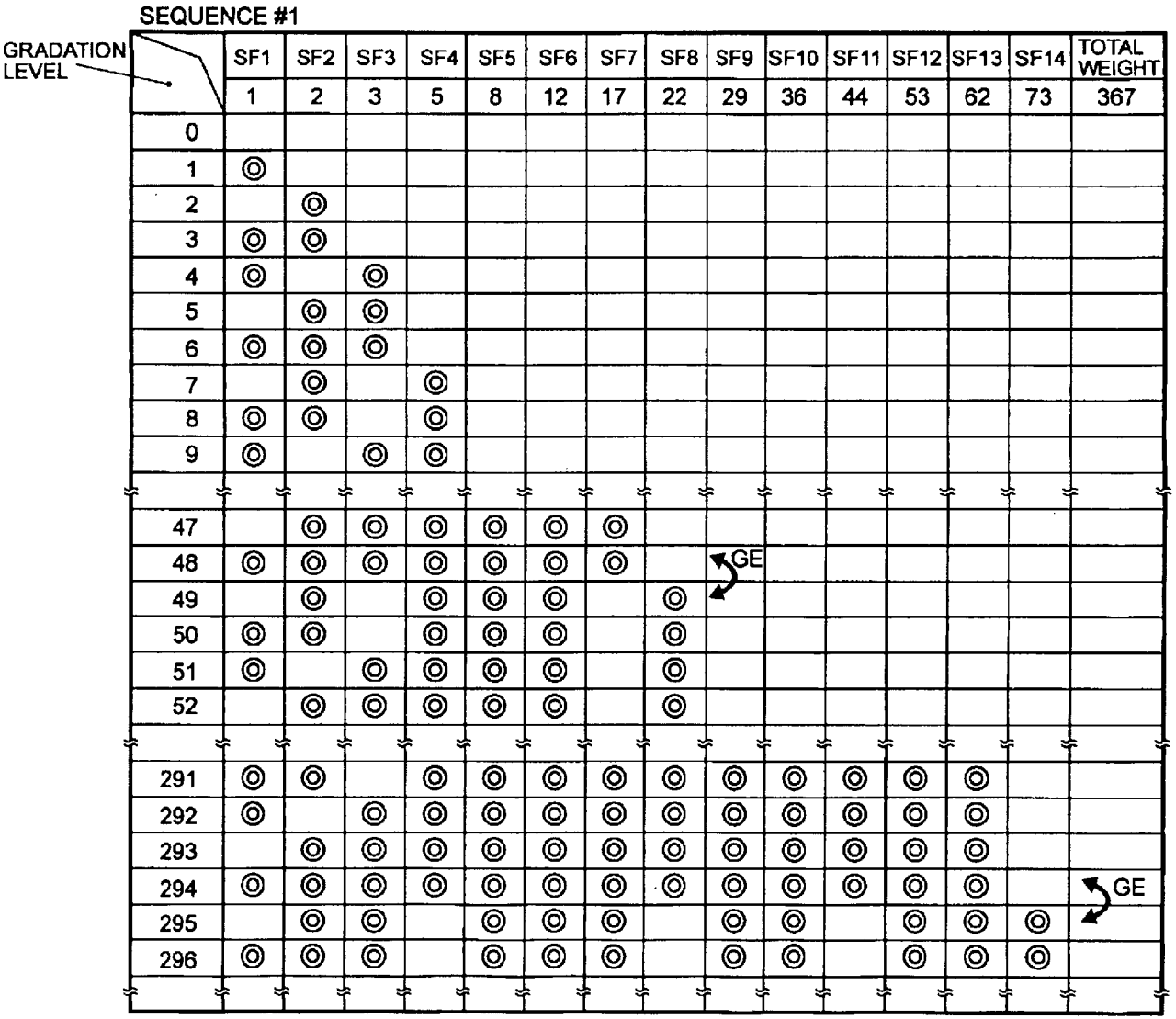
FIG. 3 shows a field sequence #1 in the first embodiment.

FIG. 3 shows the first sequence (Sequence #1) of three different field sequences. The weights of the sustaining pulses for the subfields SF1 to SF14 are set as follows: 1, 2, 3, 5, 8, 12, 17, 22, 29, 36, 44, 53, 62, and 73 respectively. Preferably, the weights are so set that the brightness curve determined by the weights approaches the reverse gamma curve of visual property. However, it is not always necessary to do so. The sum of all the weights is 367, and 368 gradations (Gr(i)=i (i=an integer greater not less than zero)) can be displayed, including the gradation (brightness) level=0. For the sake of briefness, only some of the gradation levels Gr(i) are described and illustrated. It should be noted that other gradation levels can be set in a similar manner as described below.

At each gradation level, a double circle indicates the light emitting subfield(s) of a discharge cell which are shifted to the light emission enable state in the selective write address process (maintained light emission). For example, no double circle is allocated to the subfields at the gradation level Gr(0), i.e., all the subfields SF1 to SF14 are in the non-light emitting state (brightness=0). At the gradation level Gr(7), the double circle is attached to the subfields SF2 and SF4 so that only the subfields SF2 and SF4 emit light; the subfields SF1, SF3, and SF5 to SF14 do not emit light. At the gradation level Gr(7), the sum of the weights is 7 (=2+5).

The light emitting subfields and the weights of all the subfields are so set that the number of those subfields of which light emission states are inverted between adjacent gradation levels decreases. For example, between the gradation levels Gr(47) and Gr(48), only the subfield SF1 inverts its light emission state. Between the gradation levels Gr(48) and Gr(49), four subfields (i.e., the subfields SF1, SF3, SF7 and SF8) invert their light emission state. Between the gradation levels Gr(294) and Gr(295), five subfields (i.e., the subfields SF1, SF4, SF8, SF11 and SF14) invert their light emission state.

In addition, the light emitting subfields and the weights of all the subfields are so set that two or more subfields of non-light emission state do not exist continuously between light emitting subfields at each gradation level. For example, at the gradation level Gr(49), the non-light emitting subfields are the subfields SF1, SF3 and SF7, so that the non-light emitting subfields do not continue. This holds true for any other gradation level. This setting is intended to effectively use the self priming effect by the sustained light emission.

If the gradations of all the fields are prepared based on the field sequence #1 alone, the displayed image may have a false contour. Specifically, if a viewer watches an animation containing both gradation levels Gr(48) and Gr(49), the subfields SF1 to SF7 emit light at the gradation level Gr(48) whereas the subfields SF2, SF4, SF5, SF6 and SF8 emit light at the gradation level Gr(49). Therefore, in the worst case, animation false contour corresponding to the weights of the subfields SF1, SF3 and SF7 may be observed. In short, a false contour is apt to be seen at a gradation change point (GE). The same thing can be said to an animation containing both gradation levels Gr(294) and Gr(295). In the worst case, animation false contours corresponding to the weights of the subfields SF1, SF4, SF8 and SF11 may be observed.

Figure 4:
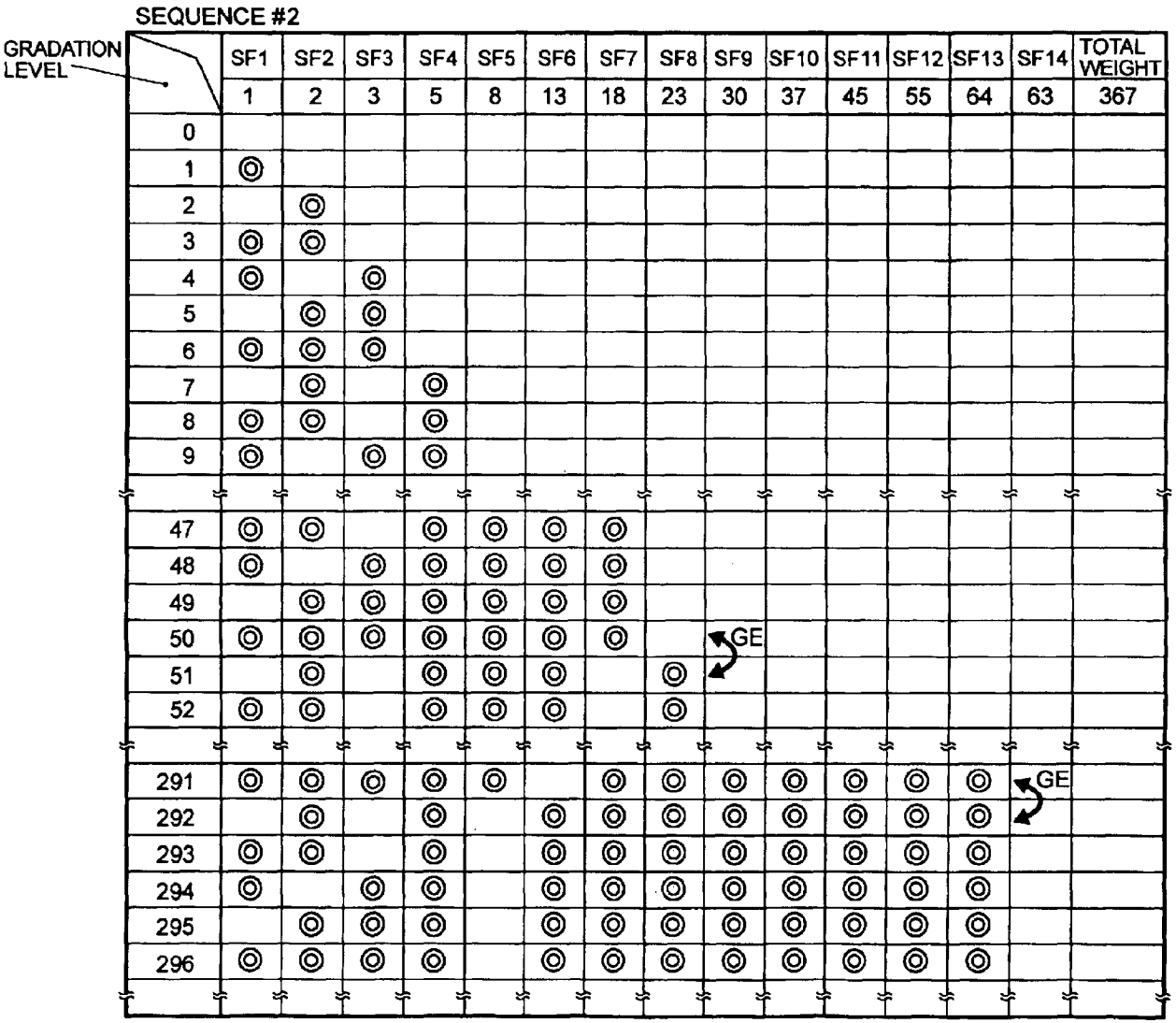
FIG. 4 shows a field sequence #2 in the first embodiment.

FIG. 4 illustrates the second sequence (Sequence #2) of the three different field sequences. The weights of the sustaining pulses for the subfields SF1 to SF14 are set as follows: 1, 2, 3, 5, 8, 13, 18, 23, 30, 37, 45, 55, 64, and 63 respectively. The weights are so selected that they are the same as those in the field sequence #1 from the subfields SF1 to SF4, and different from the subfield SF5 to SF14. Preferably, the reverse gamma curve of visual property is taken into account when the weights are determined. However, it is not always necessary to do so. Like the field sequence #1, the sum of all the weights is 367, and 368 gradation levels (Gr(i)=i) can be displayed, including the gradation (brightness) level=0. Like FIG. 3, FIG. 4 illustrates only some of the gradation levels Gr(i).

Like the field sequence #1, the light emitting subfields and the weights of all the subfields are determined by the controller 12 such that the number of those subfields of which light emission states are inverted between adjacent gradation levels decreases. In addition, the light emitting subfields and the weights of all the subfields are so set that two or more non-light emitting subfields do not continue between the first and last light emitting subfields at each gradation level.

If the gradations of all the fields are displayed based on the field sequence #2 alone, a false contour is apt to appear on a displayed image, as in the case of the field sequence #1. That is, if a viewer watches an animation containing both gradation levels Gr(50) and Gr(51) or an animation containing both gradation levels Gr(291) and Gr(292), a false contour is probably observed by the viewer. This is because the gradation levels Gr(50) and Gr(51) or the gradation levels Gr(291) and Gr(292) are gradation change points GE where a false contour is apt to be seen. However, unlike the field sequence #1, the gradation levels Gr(48) and Gr(49) do not provide a gradation change point and the viewer will not see a false contour in an animation containing both gradation levels Gr(48) and Gr(49), because their sustaining weights are different from each other by only one level. This can be said to the gradation levels Gr(294) and Gr(295). The gradation levels Gr(294) and Gr(295) do not create a gradation change point GE where a false contour is seen because their sustaining weights are different from each other by only one level. Therefore, the field sequence #2 is different from the field sequence #1 in the positions of the gradation change points GE.

Figure 5:
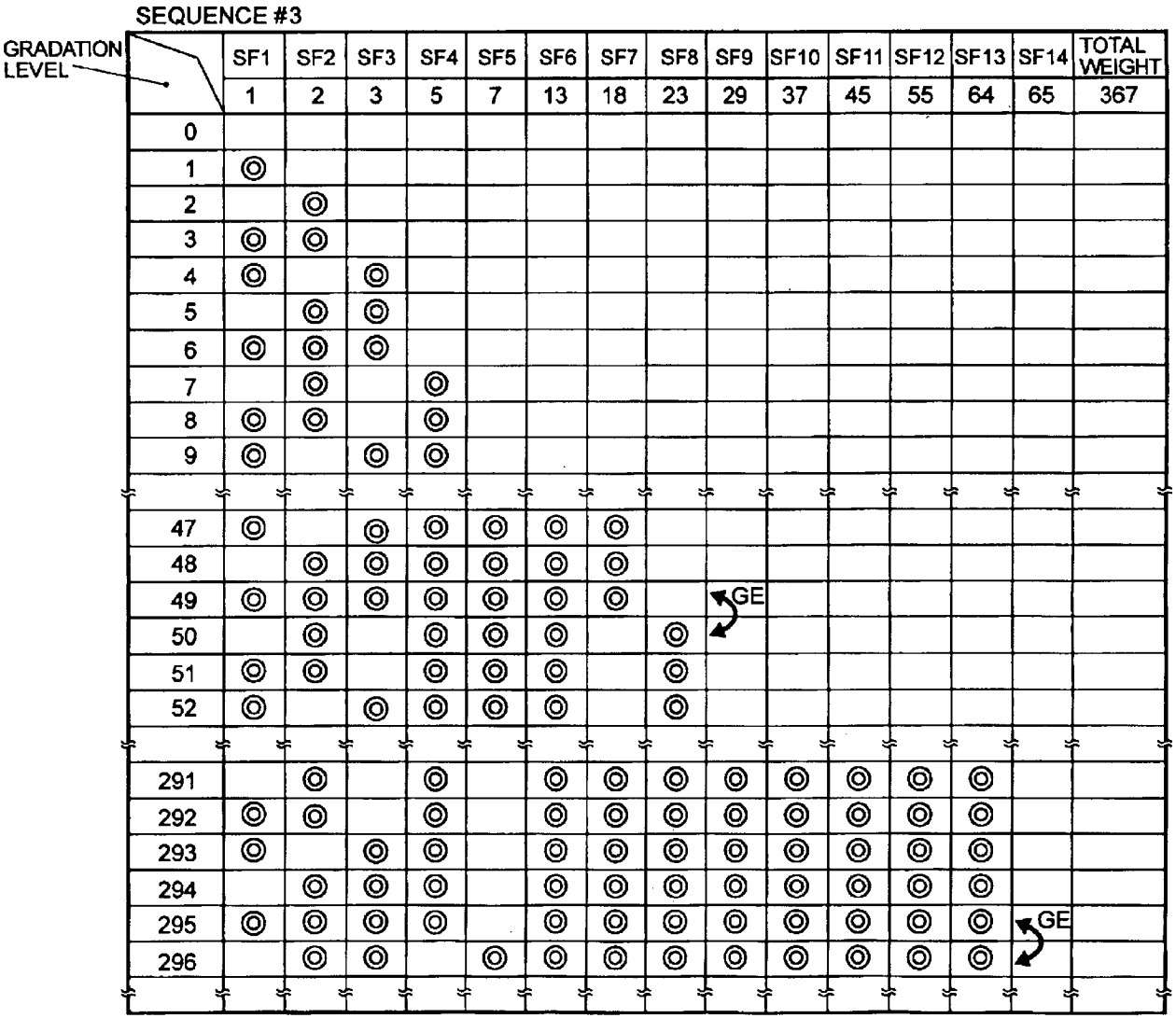
FIG. 5 shows a field sequence #3 in the first embodiment.

FIG. 5 illustrates the third sequence (Sequence #3) of the three field sequences. The weights of sustaining pulses for the subfields SF1 to SF14 are set to 1, 2, 3, 5, 7, 13, 18, 23, 29, 37, 45, 55, 64, and 65 respectively. Like the field sequences #1 and #2, the sum of the weighting is 367, and 368 gradation levels (Gr(i)=i) can be displayed, including the gradation-(brightness) level=0. The weights are the same as those in the field sequences #1 and #2 from the subfields SF1 to SF4, and different from the subfields SF5 to SF14. Like FIGS. 3 and 4, only some of the gradation levels Gr(i) are illustrated in FIG. 5.

As with the field sequences #1 and #2, the light emitting subfields and the weights of all the subfields are so set by the controller 12 that the number of those subfields of which light emission states are inverted between adjacent gradation levels decreases. In addition, the light emitting subfields and the weights of all the subfields are so set that two or more non-light emitting subfields do not continue between the first and last light emitting subfields at each gradation level.

As in the case of the field sequences #1 and #2, a false contour is apt to appear on a displayed image if the gradations of all the fields are displayed based on the field sequence #3 alone. That is, the gradation levels Gr(49) and Gr(50) establishes the gradation change point GE and the gradation levels Gr(295) and Gr(296) establishes the gradation change point GE. However, the field sequence #3 is different from the field sequences #1 and #2 in the positions of the gradation change points GE.

The controller 12 performs the field display by switching the field sequences #1 to #3 sequentially. Specifically, the controller 12 first executes the display of one field based on the field sequence #1 (FIG. 3). The controller 12 converts the pixel data PD into the pixel driving data GD consisting of the 1st to 14th bits. Each of the 1st to 14th bits corresponds to the subfields SF1 to SF14 respectively. For example, if the pixel data PD corresponds to the gradation level Gr(5), the pixel driving data GD is converted into "01100000000000". If the pixel data PD corresponds to the gradation level Gr(48), the pixel driving data GD is converted into "10111110000000". In this manner, the pixel data PD which can display 368 gradations is converted into the pixel driving data GD of 14 bits consisting of 368 patterns in all.

The memory 15 writes and stores the pixel driving data GD sequentially in response to a write signal sent from the controller 12. When the writing of the pixel driving data $GD_{11}$-$GD_{nm}$ for one screen (n rows, m columns) is completed, the memory 15 reads each of the pixel driving data $GD_{11}$-$GD_{nm}$ for the same bit digits, for one display line at a time, sequentially in response to a read signal sent from the controller 12, and supplies the data to the address driver 16.

The controller 12 sends a clock signal to the A/D converter 14 and a write/read signal to the memory 15 in synchronization with the horizontal synchronization signal H and the vertical synchronization signal V. In addition, the controller 12 drives the PDP 10 by sending various signals to the address driver 16, the first sustaining driver 17, and the second sustaining driver 18 to execute the reset process Rc, the selective write address process Wo, the light emission maintaining process Ic, and the light-extinguishing process E in accordance with the drive format shown in FIG. 2 and the field sequence shown in FIG. 3. By so doing, one field is displayed.

Next, the controller 12 executes the display operation for the next field by using the field sequence #2 (FIG. 4) in the same manner as described above. By this switching of the field sequences (field alternation), the gradation change point GE that causes a false contour changes, so that the false contour becomes invisible.

After executing the display operation for this field, the controller 12 executes the display operation for the next field by using the field sequence #3 (FIG. 5). By this field alternation, the gradation change point GE that causes a false contour shifts, so that the false contour becomes invisible.

By repeatedly executing the display operation for the three fields, the occurrence of a false contour can be prevented.

Second Embodiment

A second embodiment of the present invention will be described with reference to FIGS. 1 and 6 to 9. Similar reference numerals are used to designate similar elements in the first and second embodiments. The structure of the PDP device 5 shown in FIG. 1 is already described in the first embodiment so that it is not described here.

Figure 6:
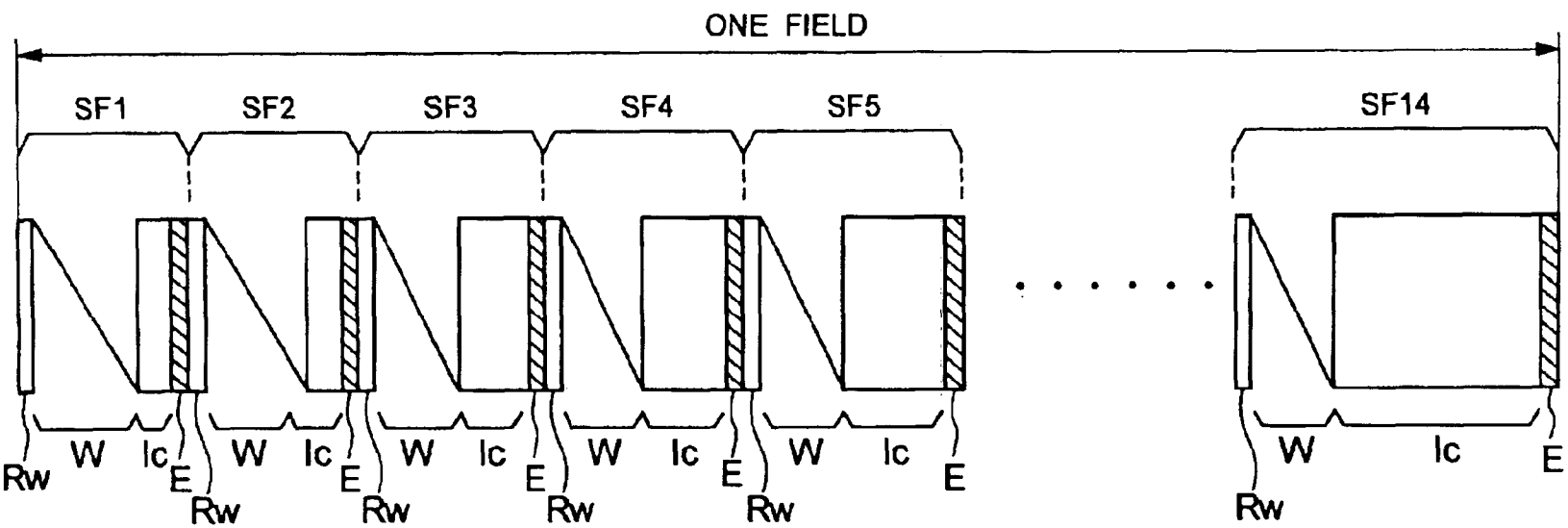
FIG. 6 shows a light emission format in a second embodiment according to the present invention.

FIG. 6 shows the drive format of the second embodiment. The controller 12 divides the display period of one field of a video signal into 14 subfields (SF1 to SF14), drives each cell and displays gradations in the same manner as the first embodiment. The second embodiment is different from the first embodiment in that gradations are displayed by the selective erasing address method. That is, the selective write address method in the first embodiment is replaced by the selective erasing address method in the second embodiment, and each process performed in the subfields is designed to conform with the selective erasing address method. More particularly, each of the subfields SF1 to SF14 includes a reset process (Rw), a selective erasing address process (Wi), a light emission maintaining process (Ic), and an overall light-extinguishing process (E).

In the reset process Rw, all the discharge cells are initialized to the light emission possible state (light emission enable state). The selective erasing address process Wi is an address process for selectively setting the discharge cells of the PDP 10 to the light emission forbidden state (light emission disable state) based on an input video signal. In the light emission maintaining process, the discharge cell(s) which is not set to the light emission disable state in the selective erasing address process Wi (i.e., discharge cell(s) maintained at the light emission enable state) emits light for a period (frequency) corresponding to the number of sustaining pulses applied. In the overall light-extinguishing process E of each subfield, all the discharge cells are set to the light emission disable state.

The controller 12 displays multiple gradations by causing the subfields to emit light sequentially starting from the first subfield SF1. In the second embodiment, as in the first embodiment, the combinations of the light emitting subfields in the first to third field sequences #1 to #3 are different from each other at, at least one gradation levels. In addition, there is provided a plurality of field sequences such that the weights of the subfields and the combinations of the light emitting subfields for the respective gradation levels are specified to reduce the number of those subfields of which light emission states are inverted between adjacent gradation levels.

Three field sequences used in the second embodiment will be described with reference to FIGS. 7 to 9.

Figure 7:
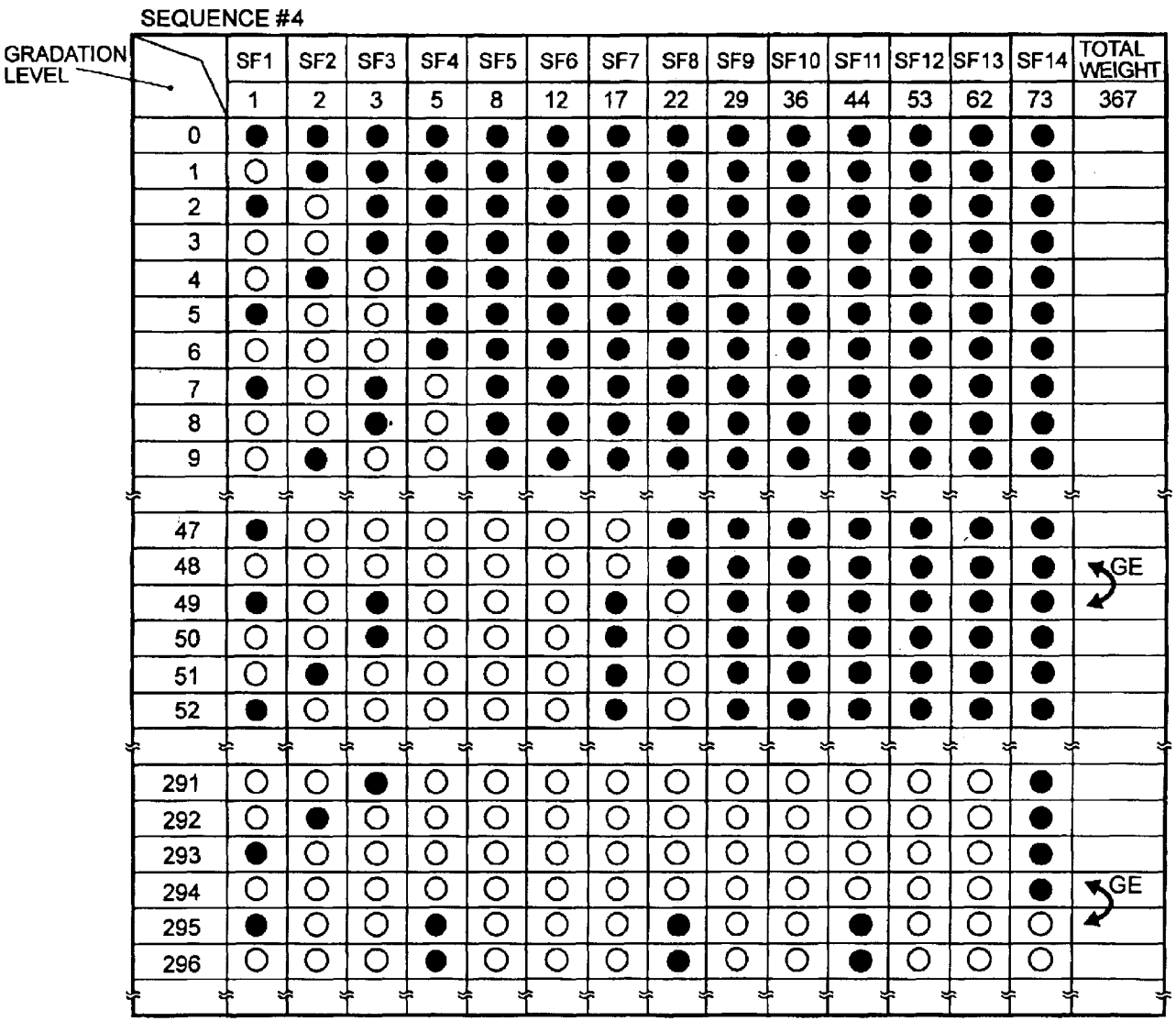
FIG. 7 shows a field sequence #4 in the second embodiment.

FIG. 7 shows the first sequence (Sequence #4) of the three field sequences. The weights of the sustaining pulses for the subfields SF1 to SF14 are set as follows: 1, 2, 3, 5, 8, 12, 17, 22, 29,36, 44, 53, 62, and 73 respectively. Preferably, the weights are so set that the brightness curve determined by the weighting approaches the reverse gamma curve of visual property. However, it is not always necessary to do so. The sum of all the weights is 367. 368 gradation levels (Gr(i)=i) can be created, including the gradation (brightness) level=0. As is the case with the first embodiment, only some of the gradation levels Gr(i) are shown in FIG. 7 for the sake of simplification.

At each gradation level, a white circle indicates a subfield which is maintained at the light emission enable state by the selective erasing address process. In short, the white circle indicates a light emitting subfield and a discharge cell thereof keeps emitting light. A black circle indicates a subfield which is set to the non-light emission state by the selective erasing address, i.e., no light emitting subfield. For example, at the gradation level Gr(0), all the subfields SF1 to SF14 are in the non-light emission state (brightness=0). At the gradation level Gr(7), the white circle is allocated to the subfields SF2 and SF4 so that light is emitted only in the subfields SF2 and SF4; the subfields SF1, SF3, and SF5 to SF14 are in the non-light emission state. At the gradation level Gr(7), the sum of the weights is 7 (=2+5).

In addition, the light emitting subfields and the weights of all the subfields are so set that the number of those subfields of which light emission states are inverted between adjacent gradation levels decreases. For example, between the adjacent gradation levels Gr(47) and Gr(48), only the subfield SF1 inverts its light emission state. Between the gradation levels Gr(48) and Gr(49), four subfields, namely, the subfields SF1, SF3, SF7, and SF8, invert their light emission state. Between the gradation levels Gr(294) and Gr(295), five subfields, namely, the subfields SF1, SF4, SF8, SF11 and SF14, invert their light emission state.

Further, the light emitting subfields and the weights of all the subfields are so set that two or more subfields which become non-light emitting subfields do not continue between the first and last light emitting subfields at each gradation level. For example, at the gradation level Gr(49), the non-light emitting subfields are the subfields SF1, SF3, and SF7. Thus, non-light emitting subfields do not continue. This holds true for other gradation levels.

If the gradations of all the fields are prepared based on the field sequence #4 alone, a displayed image may have a false contour. This is because a gradation change point GE arises between the gradation levels Gr(48) and Gr(49). A false contour appears when a viewer watches an animation containing both gradation levels Gr(48) and Gr(49). A false contour is also observed when watching an animation containing the gradation levels Gr(294) and Gr(295).

Figure 8:
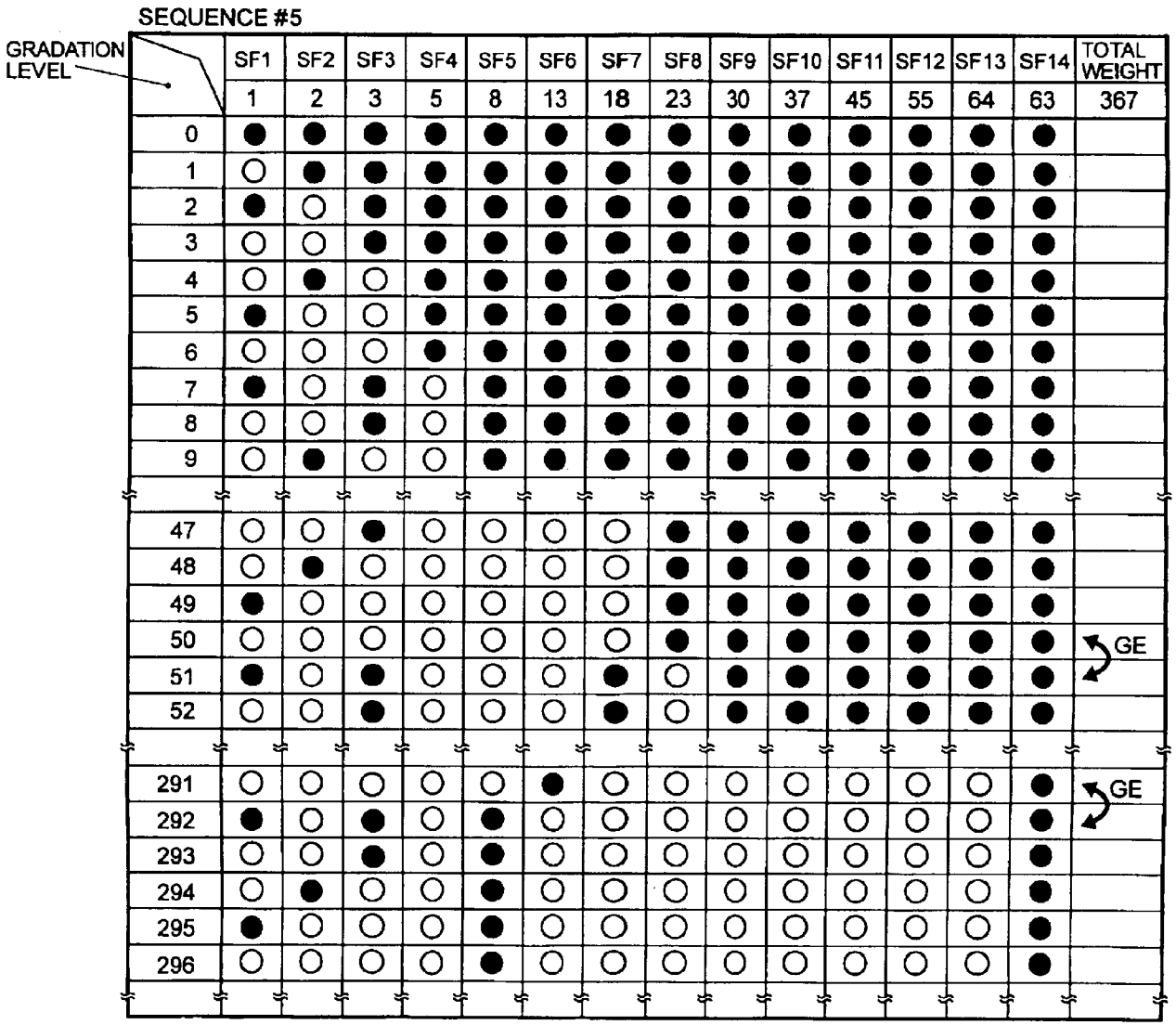
FIG. 8 shows a field sequence #5 in the second embodiment.

FIG. 8 illustrates the second sequence (field sequence #5) of the three field sequences. The weights of the sustaining pulses for the subfields SF1 to SF14 are set as follows: 1, 2, 3, 5, 8, 13, 18, 23, 30, 37, 45, 55, 64 and 63 respectively. The weights of the subfields SF1 to SF4 in the field sequence #5 are the same as the subfields SF1 to SF4 in the field sequence #4, and the weights of the subfields SF5 to SF14 in the field sequence #5 are different from the field sequence #4. Like the field sequence #4, the sum of the weight is 367, and 368 gradation levels (Gr(i)=i) are displayed.

Figure 9:
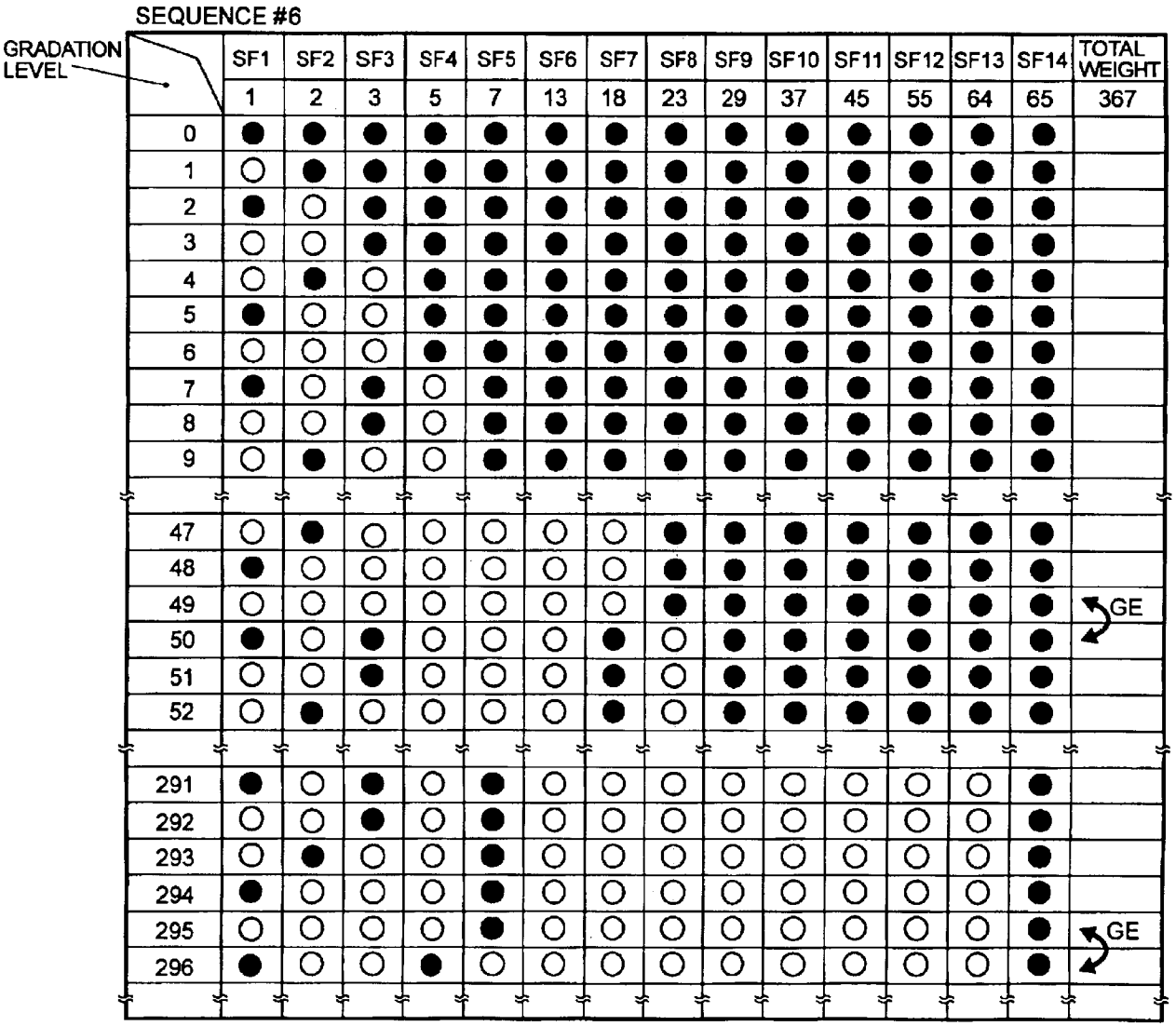
FIG. 9 shows a field sequence #6 in the second embodiment.

FIG. 9 illustrates the third sequence (field sequence #6) of the three field sequences. The weights of the sustaining pulses for the subfields SF1 to SF14 are set to 1, 2, 3, 5, 7, 13, 18, 23, 29, 37, 45, 55, 64 and 65 respectively. Like the field sequences #4 and #5, the total of the weights is 367, and 368 gradation levels (Gr(i)=i) can be created. The weights of the subfields SF1 to SF4 in the field sequence #6 are the same as the subfields SF1 to SF4 in the field sequences #4 and #5. The weights of the subfields SF5 to SR14 in the field sequence #6 are different from the field sequences #4 and #5.

The field sequence #4 is similar to the field sequences #5 and #6 in the following aspects: the light emitting subfields and the weights of all the subfields are so set by the controller 12 that the number of those subfields of which light emission states are inverted between adjacent gradation levels decreases. In addition, the light emitting subfields and the weights of all the subfields are so set that two or more non-light emitting subfields do not continuously exist between the first and last light emitting subfields at each gradation level.

In the field sequence #5, the gradation levels Gr(50) and Gr(51) create the gradation change point GE where a false contour is apt to be seen. The gradation levels Gr(291) and Gr(292) also create the gradation change point GE.

In the field sequence #6, the gradation levels Gr(49) and Gr(50) provide the gradation change point GE, and the gradation levels Gr(295) and Gr (296) provide the gradation change point GE.

The controller 12 sends a clock signal to the A/D converter 14 and a write/read signal to the memory 15 in synchronism with the horizontal synchronizing signal H and the vertical synchronizing signal V. In addition, the controller 12 drives the PDP 10 by sending various signals to the address driver 16, the first sustaining driver 17 and the second sustaining driver 18 to execute the reset process Rw, the selective erasing address process Wi, the light emission maintaining process Ic, and the light-extinguishing process E in accordance with the driving format shown in FIG. 6 and the field sequence #4 in FIG. 7. By so doing, one field is displayed.

Next, the controller 12 executes the display operation for the next field by using the field sequence #5 (FIG. 8) in the same manner as described above. After executing the display for this field, the controller 12 executes the display operation for the next field by using the field sequence #6 (FIG. 9). The gradation change point GE shifts upon this field alternation (switching), so that the false contour becomes invisible. That is, the occurrence of a false contour can be prevented by displaying the fields alternating in accordance with the field sequences described above.

Third Embodiment

Figure 10A:
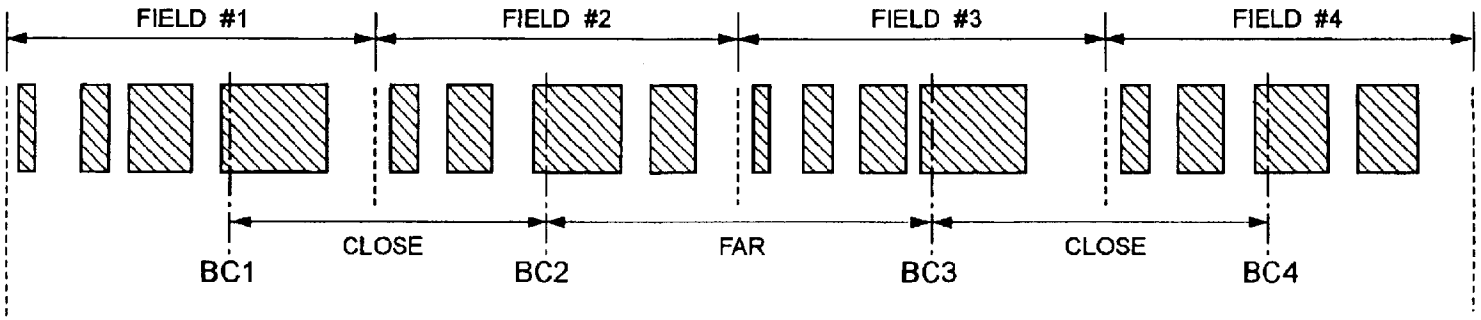
FIG. 10A schematically depicts a plurality of fields when intervals between brightness centroids (centers) of the fields are not constant.

Flickering may occur with the above-mentioned field alternation. The flickering can be prevented by shifting the start timing of a specific field. This flickering prevention will be described below. For example, as is schematically shown in FIG. 10A, the time intervals between the brightness centroids (centers) BC (BC1, BC2, BC3 and BC4) of the fields #1 to #4 differ from each other depending on the light emission pattern in each field. It should be noted that the brightness centroid BC is determined by the center (half) value of the total weights of the light emitting subfields. The time interval between the fields #1 and #2 is relatively short. In other words, the centroids of the fields #1 and #2 are relatively close to each other. The time interval between the fields #2 and #3 is relatively long. In other words, the centroids of the fields #2 and #3 are relatively far from each other. Such irregular time intervals cause flickering.

Figure 10B:
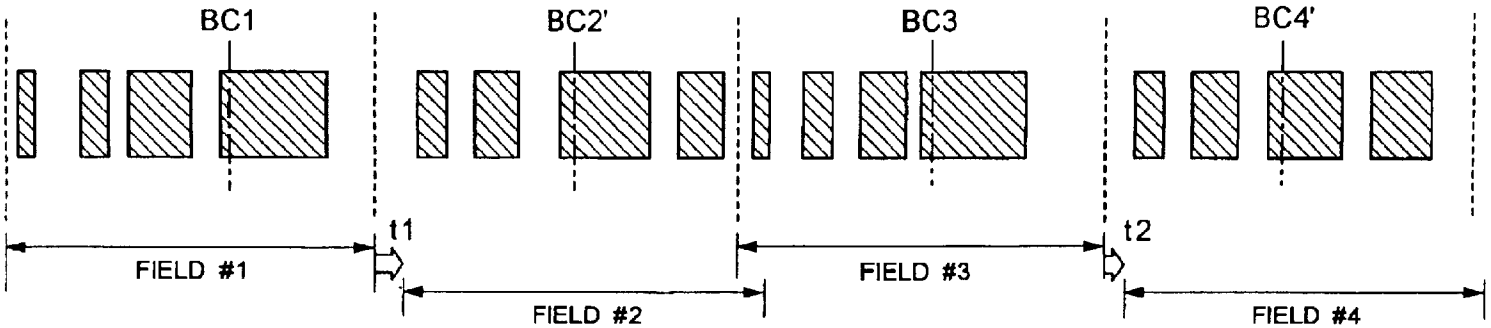
FIG. 10B schematically depicts a method for adjusting the brightness centroid intervals by shifting the start timing of the fields.

The controller 12 calculates the time interval between each two adjacent brightness centroids BC from the light emission patterns of the subfields in the field sequence, and adjusts the field start timing so that the time intervals become substantially constant. Alternatively, the controller 12 may adjust the field start timing when the calculated time interval is not within a predetermined range. Thus, each time interval falls within the predetermine range. For example, as shown in FIG. 10B, the start time of the field #2 is delayed by t1 and the start time of the field #4 is delayed by t2. As a result, the time interval irregularities between the four brightness centroids BC (BC1, BC2', BC3 and BC4') are confined within a certain range. The occurrence of flickering can be therefore prevented.

In the above described and illustrated embodiments, the three field sequences are used (three-field alternation). It should be noted, however, that two, four or more field sequences may be used. False contours can be more effectively reduced by increasing the number of alternations. It is not necessary to apply the field alternation for every field. For example, the field alternation may be made for two or more fields.

The embodiments have been described with reference to the plasma display panel, but the present invention can be applied to any display panel in which gradations are displayed according to the subfield method.

Various changes and modifications may be made by those skilled in the art without departing from the spirit and scope of the present invention. Such changes and modifications are encompassed by the present invention which are defined by the appended claims.

This application is based on a Japanese patent application No. 2002-25012, and the entire disclosure thereof is incorporated herein by reference.

What is claimed is:

1. A method of driving a display panel for each group of subfields defining one field of a video signal, the each group of subfields being arranged from a front subfield to a last subfield, the display panel including a plurality of row electrodes and a plurality of column electrodes intersecting with the plurality of row electrode such that a light emissive cell is formed at each intersection of the plurality of row electrodes and the plurality of column electrodes, comprising:

A) determining a light emission weight of each subfield and a combination of light emitting subfields at each gradation level such that the number of subfields having different light emission states between two adjacent gradation levels is less than a predetermined value;

B) providing a plurality of field display sequences such that the combinations of the light emitting subfields at at least one gradation level are different from each other between the plurality of field display sequences; and C) sequentially displaying a plurality of fields by changing a currently used field display sequence to another field display sequence each time a predetermined number of fields of the video signal are displayed.

2. The method according to claim 1, wherein the light emission weights of subfields corresponding between the plurality of field display sequences are the same when the light emission weight is smaller than a predetermined value.

3. The method according to claim 2, wherein the each group of subfields defines one display period of the one field of the video signal, the each group of subfields includes at least eight subfields, and a ratio of the light emission weights of four subfields having least weights of the at least eight subfields is 1:2:3:5.

4. The method according to claim 1 further comprising adjusting a start timing of each field display sequence at each gradation level such that a time interval between centroids of light emission weights of light emitting subfields in each field is within a predetermined range.

5. The method according to claim 1, wherein the light emitting subfields and the light emission weights are determined such that two or more non-light emitting subfields do not continuously exist between the light emitting subfields at each gradation level.

6. The method according to claim 1, wherein each of the subfields includes a selective write address process and a light emission sustaining process, and only the front subfield includes a reset process prior to the selective write address process.

* * * * *